United States Patent [19]

Wild

[11] Patent Number: 5,050,407

[45] Date of Patent: Sep. 24, 1991

[54] COMBINATION UNBALANCED LOAD AND LID SWITCH ASSEMBLY

[75] Inventor: Daniel J. Wild, Oshkosh, Wis.

[73] Assignee: Speed Queen Company, Lexington, Mass.

[21] Appl. No.: 599,952

[22] Filed: Oct. 19, 1990

[51] Int. Cl.[5] ..... D06F 33/02; D06F 37/28

[52] U.S. Cl. ..... 68/12.06; 68/12.26; 192/136; 210/144; 292/DIG. 69

[58] Field of Search ..... 68/12.06, 12.26, 23 R; 210/144, 162; 292/DIG. 69; 192/136; 200/61.62

[56] References Cited

U.S. PATENT DOCUMENTS

| | | | |
|---|---|---|---|
| 2,882,360 | 4/1959 | Sisson | 68/23 R X |
| 3,051,313 | 8/1962 | Stelli | 210/144 |
| 3,145,818 | 8/1964 | Stelli | 210/144 X |
| 3,227,835 | 1/1966 | Conrath | 210/144 X |
| 3,504,777 | 4/1970 | Waugh | 68/23 R X |
| 4,098,098 | 7/1978 | Altnau | 68/23 R |
| 4,449,383 | 5/1984 | Cartier | 68/12.26 X |

*Primary Examiner*—Philip R. Coe

*Attorney, Agent, or Firm*—William R. Clark; Richard M. Sharkansky

[57] ABSTRACT

A combination unbalanced load and lid switch assembly for an automatic washing machine. A switch is mounted to the side wall of a box-like housing with a spring clip that has a pair of legs extending through horizontal holes in the switch. The switch housing has a diagonally extending horizontal flange with a downwardly extending pivot portion to which is pivotally mounted a lid lever. One end of the lid lever has an actuator arm which extends in aligment to a wire extension of the lid hinge that moves upwardly as the lid is being closed to push the actuator arm upwardly. A substantially vertical unbalanced load lever is pivotally connected to the opposite end of the lid lever and is pulled downwardly against a biasing spring as the lid is closed. The unbalanced load lever has an actuating finger that depresses the plunger of the switch thereby enabling the washer motor when the lid is closed. The unbalanced load lever also has a downward leg that is engagable by the tub during an out-of-balance excursion. Pivoting of the unbalanced load lever about the lid lever causes the actuating finger to slide off the switch plunger thereby disabling the motor until the lid is opened and closed.

14 Claims, 5 Drawing Sheets

COMBINATION UNBALANCED LOAD AND LID SWITCH ASSEMBLY

BACKGROUND OF THE INVENTION

The field of the invention generally relates to automatic washing machines, and more particularly relates to unbalanced load and lid switch controls for such washing machines.

As is well known, a typical top-loading automatic washing machine has a lid switch that is connected in series with the motor to prevent the motor from being energized when the lid is open. The lid switch provides an interlock safety feature wherein access to the clothes basket is prevented during agitation and high speed spin. A typical top-loading automatic washing machine also has an unbalanced load switch that de-energizes the motor during high speed spin if the lateral excursion of the outer tub reaches a point where the tub trips the unbalanced load switch. The unbalanced load switch functions to prevent damage to the washing machine when the clothes load is not adequately balanced. Washing machines that use a separate switch for the lid switch function and the unbalanced load function have the added cost of a second switch and associated mounting apparatus.

Some prior art devices have used a single switch to provide the functions of both a lid switch and an unbalanced load switch. In one approach, the switch is mounted to a bracket that is positioned underneath the top panel of the cabinet. The lid has a downwardly extending prong that is aligned to insert through a small aperture near the front of the lid recess. In the closed lid position, the prong pushes against a biased lever that pushes up against the downwardly extending plunger of the switch. With this arrangement, the lid switch function can be overridden by inserting a screwdriver or other similar tool through the aperture to push the lever down while the lid is open. Overriding the lid switch function enables a maintenance technician to perform certain diagnostic testing, but the insertion of a tool through the aperture may chip the enamel resulting in rusting around the aperture. Another drawback of the device is that the switch bracket mounts between horizontal inwardly directed underside flanges of the top panel at the side and front. These flanges may not always be precisely aligned due to production tolerances and, as a result, factory and/or field adjustments may be necessary to make the switch function properly. Such adjustments are expensive.

In another prior art device using a single switch for combined functions, a horizontal piston actuator with a forward bias extends into the lid recess from a cylinder mounted behind the rear wall of the recess. When the lid is closed, the rear of the lid pushes the piston rearwardly. The piston is coupled to an arm that pushes against the plunger of the switch. The arm also has a downward extension or paddle that can be pushed forward by a tab on the tub to activate the unbalanced load function. Such arrangement has a drawback in that a quarter or other similar object can be positioned between the lid and the piston within the lid recess to permanently override the lid switch function. This action could result in unsafe operations such as spinning with the lid open. Also, the coin or other similar object could wear or chip the enamel on the lid.

SUMMARY OF THE INVENTION

It is an object of the invention to provide an improved assembly that uses only one switch that disables the motor of a washing machine if the lid is open or if there is a unbalanced load during a spin cycle.

It is a further object to provide a combination unbalanced load and lid switch assembly wherein the actuation is concealed underneath the top panel of the cabinet. That is, it is an object that an actuation mechanism not protrude into the top panel recess for the lid.

It is also an object to provide a combination unbalanced load and lid switch assembly that can readily and easily be assembled from sheet metal parts without the expense or labor involved in using fasteners such as screws.

It is an object to provide a switch holder that also serves as an enclosure for shielding the switch and its terminals.

It is a further object to provide a switch assembly that can be attached to the top panel with a minimum of labor and adjustment.

Another object is to provide a combination switch assembly that can be readily overridden by a service technician during diagnostic maintenance, but which is generally hidden from the user.

It is a further object that the switch be overridden without chipping or damaging visible enamel of the top panel.

It is a further advantage that the combination unbalanced load and lid switch assembly only be reset by opening the lid after the switch is tripped by an unbalanced load condition.

It is a further object that the switch be readily mountable in a side wall of a box-like housing with a minimum of labor.

In a washing machine having a clothes basket positioned in a tub inside a cabinet having a lid and means for spinning said clothes basket during a spin cycle, the above described objects and advantages are provided by a switch assembly for disabling the spinning means whenever the lid is open or whenever the clothes basket has an unbalanced load during one of the spin cycles. The switch assembly comprises a switch having a plunger, a lid lever comprising a pivot and an actuator arm responsive to the lid being in a closed position for pivoting the lid lever, and an unbalanced load lever comprising a switch plunger actuating finger wherein the unbalanced load lever is pivotally linked to the lid lever so that the unbalanced load lever is pulled by the lid lever such that the actuating finger depresses the switch plunger when the lid lever is pivoted by closing the lid. The unbalanced load lever further comprises a downward extension responsive to lateral excursion of the tub during a spin cycle caused by an unbalanced load in the clothes basket for pivoting the unbalanced load lever with respect to the lid lever wherein the actuating finger slides off the switch plunger to disable the spinning means.

It is preferable that the spinning means comprise a motor and the switch be a normally open switch in series therewith. The washing machine may also preferably comprise means for biasing the unbalanced load lever to a position where the switch plunger is not depressed by the actuating finger when the lid lever is not pivoted by the lid being closed. The biasing means preferably comprises a spring connected to the unbalanced load lever. The lid may preferably have a wireform hinge with an angle extension that moves upwardly as the lid is being closed so as to apply a pivoting force to the lid lever. The lid lever preferably has an extension that is aligned with a hole in the top panel behind the control console wherein an implement can be pushed down through the hole to pivot the lid lever when the lid is open so as to override the switch during diagnostic maintenance.

BRIEF DESCRIPTION OF THE DRAWINGS

The foregoing objects and advantages will be more fully understood by reading the Description of the Preferred Embodiments with reference to the drawings wherein.

DESCRIPTION OF THE PREFERRED EMBODIMENTS

Figure 1:
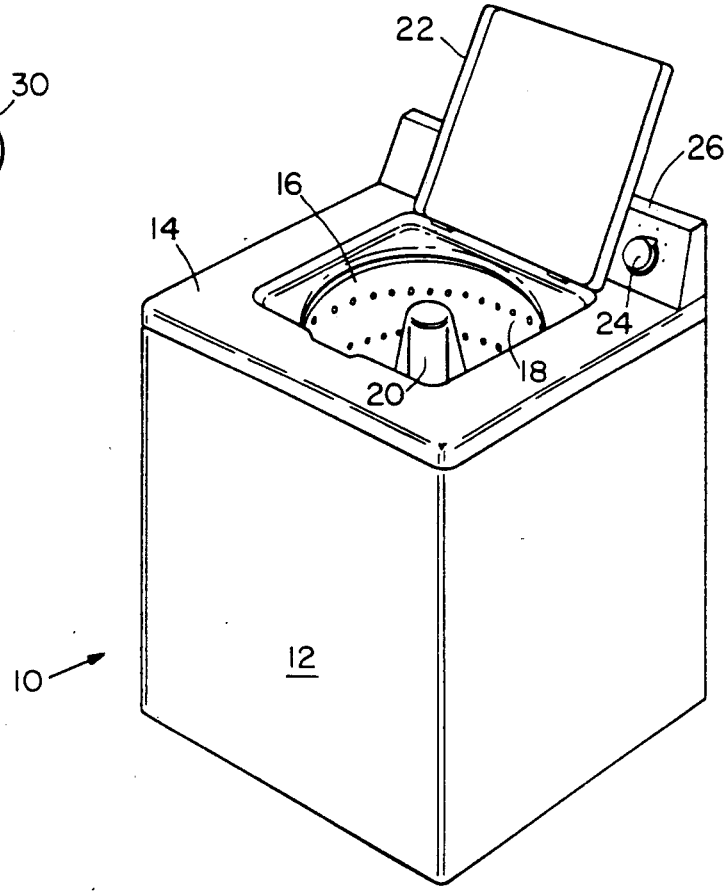
FIG. 1 is a perspective view of a top loading washing machine.
Figure 9:
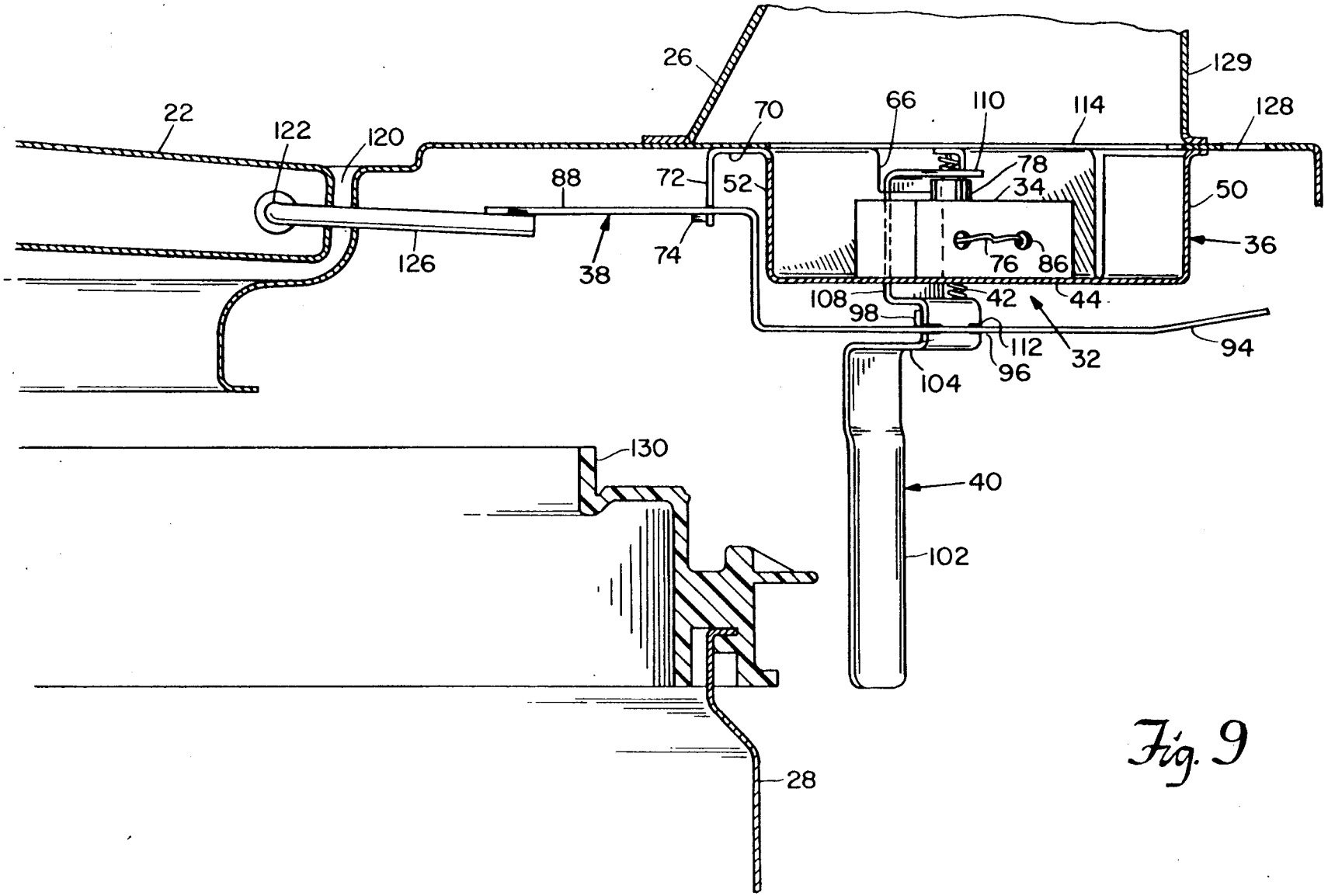
FIG. 9 is a side-sectioned view of the combination switch assembly and the outer tub.

FIG. 1 shows a top loading or vertical axis automatic home washing machine 10 which has a cabinet 12 having a top panel 14 with an access opening 16 for loading and retrieving clothes from a perforated clothes basket 18. An agitator 20 is positioned within clothes basket 18. In conventional manner, clothes to be washed are loaded through access opening 16 into clothes basket 18 and, after the lid 22 is closed and the controls 24 on console hood 26 are set, washing machine 10 sequences through a plurality of cycles. For example, such cycles typically include wash, rinse, and spin cycles. During wash and rinse cycles, the outer tub 28 (FIG. 9) is filled with water and agitator 20 is driven back and forth by motor 30 (FIG. 10) through a predetermined arc to agitate or scrub the clothes so as to remove soil. During a spin cycle, the wash water is drained from the tub 28, and the clothes basket 18 is rotated about its vertical axis by motor 30 at a relatively high speed to extract moisture from the clothes by centrifugal force.

Figure 2:
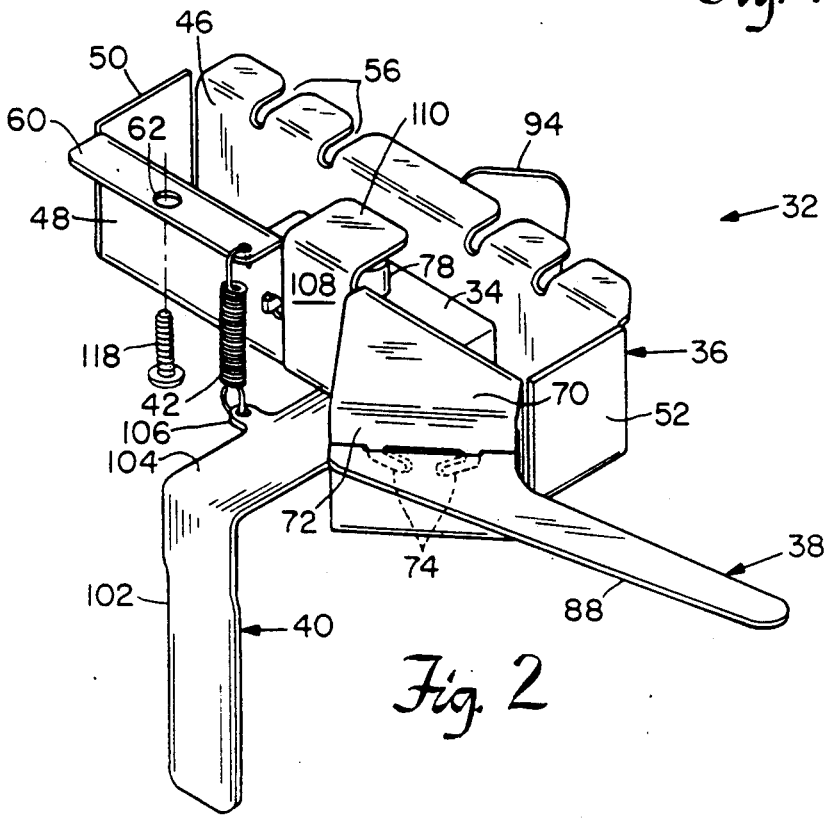
FIG. 2 is a perspective view of a combination unbalanced load and lid switch assembly.

FIG. 2 shows a perspective view of a combination lid and unbalanced load switch assembly 32. As will be described in detail later herein, switch assembly 32 is mounted to the underside of top panel 14 approximately underneath console hood 26, and functions to disable motor 30 whenever the lid 22 is open or whenever outer tub 28 has a predetermined lateral excursion during a spin cycle due to an unbalanced clothes load in clothes basket 18.

Figure 3:
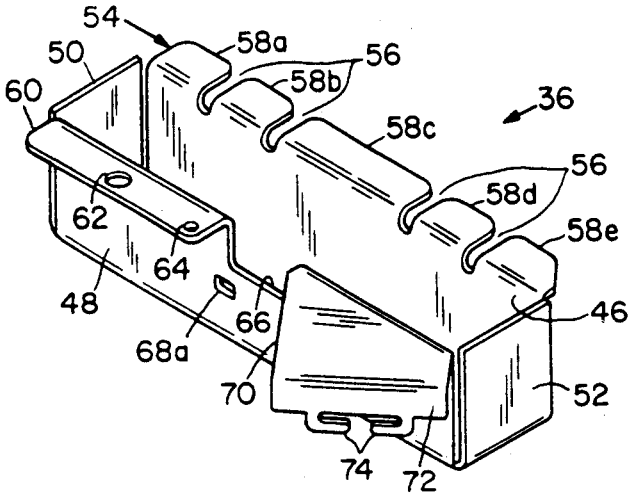
FIG. 3 is a perspective view of the switch housing for the assembly.

Still referring to FIG. 2, combination lid and unbalanced load switch assembly 32 includes switch 34, switch holder 36, lid lever 38, unbalanced load lever 40, and spring 42. With reference also to FIG. 3, switch holder 36 is a box-like sheet metal part and includes a bottom 44 (FIG. 9) side walls 46 and 48, and end walls 50 and 52. Side wall 46 has a horizontal flange 54 with a plurality of slits 56 thus forming a plurality of mounting tabs **58*a*–58*e*. Side wall 48 has a horizontal flange 60 or lip with a mounting hole 62 and a spring attaching hole 64. The central portion of side wall 46 has a downwardly extending notch 66 with a pair of spaced slots 68*a* and 68*b* (FIG. 6) located therebelow. Side wall 48 also has a diagonally projecting horizontal arm 70 that has a downwardly extending pivot portion 72 with two attaching fingers 74**.

Figure 5:
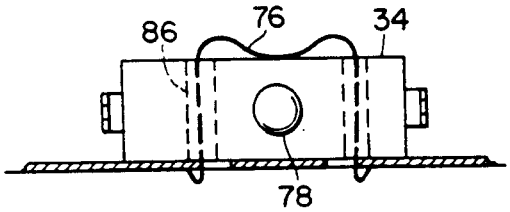
FIG. 5 is a view of the spring clip mounting the switch to a side wall of the switch housing.
Figure 4:
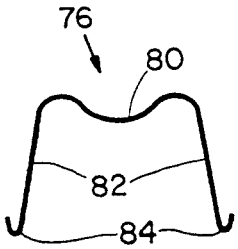
FIG. 4 is a view of a spring clip.
Figure 6:
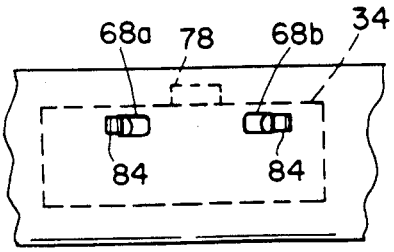
FIG. 6 is an elevation view of the side wall of the switch housing.

Still referring to FIGS. 2 and 3, and also to FIGS. 4–6, spring clip 76 is used to attach switch 34 to side wall 48 with the plunger 78 projecting upwardly. Spring clip 76 is made of spring steel and has a 0.347" radius bend portion 80 and a pair of legs 82 that terminate in hook ends 84. As shown in FIG. 4, legs 82 extend outwardly 10° from lateral when spring clip 76 is untensioned. In assembly, the legs 82 are inserted through conventional switch mounting holes 86 that are spaced by 1". The switch 34 with clip 76 is then lowered into switch holder 36 and attached to the holder 36 by pushing the hook ends 84 through rectangular slots **68*a* and 68*b* that are punched in side wall 48. The hook ends 84 force legs 82 inwardly toward each other as the hood ends 84 are pushed through slots 68*a* and 68*b*, and then hook ends 84 and legs 82 spring outwardly after hook ends 84 protrude through slots 68*a* and 68*b*. Switch 34 is securely attached to side wall 48. Holes 86 in conventional switch 34 are normally used to mount switch 34 using screws, but spring clip 76 is much easier to use during fabrication because switch 34 is installed in the boxed-in enclosure of switch holder 36 where access to screw heads would be restricted. The 10° outward bend on the legs 82 of spring clip 76 and the hooked ends 84 provide a spring force that is needed to keep the clip 76 and switch 34 secured to the holder 36 even though a downward force is applied on plunger 78 to close switch 34. Notwithstanding the secured attachment of switch 34 within switch holder 36, spring clip 76 can be released from the holder 36 by inserting a thin piece of metal between the switch 34 and side wall 48 to unhook one leg 82 of the clip, or by pushing on one hook end 84 of one of the clip legs 82 on the outside of side wall 48. Another advantage of spring clip 76 over conventional screw type attachment is that spring clip 76** provides a constant force while care must be made to tighten screws with the proper torque to avoid cracking the switch housing.

Figure 7:
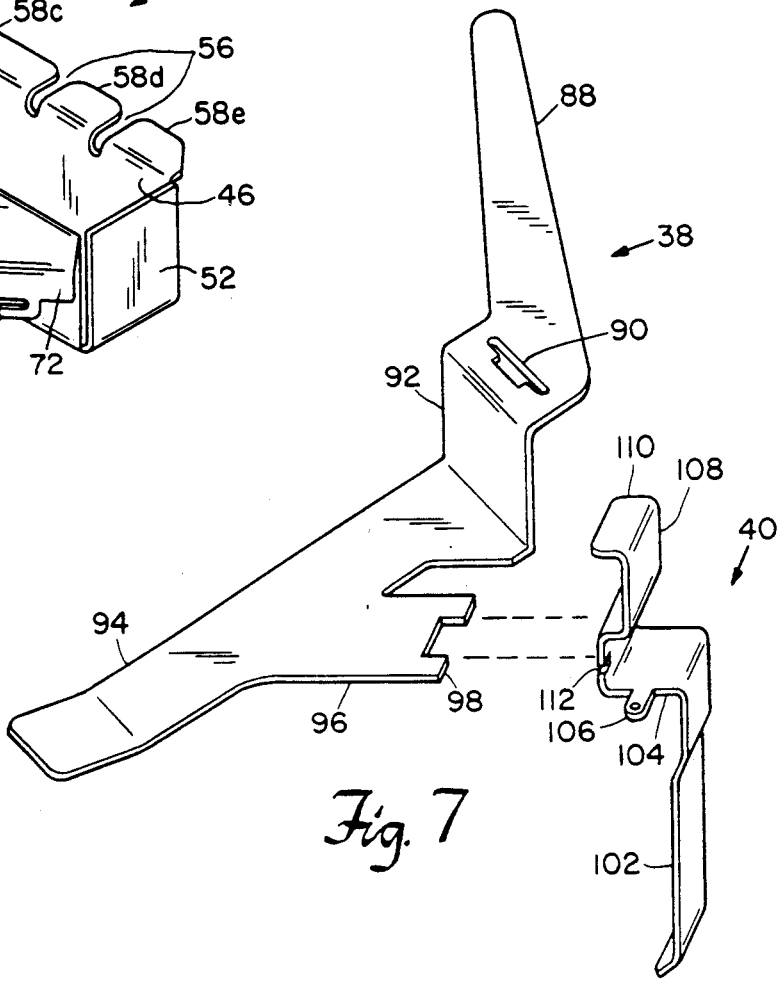
FIG. 7 is an exploded view of the lid lever and unbalanced load lever of the switch assembly of FIG. 2.

Referring to FIG. 7, lid lever 38 is a sheet metal part and includes an actuator arm 88 having a slot 90, a vertical spacer wall 92 and an extension 94 with a diagonally projecting linkage 96 having pointing prongs 98. Unbalanced load lever 40 also is a sheet metal part, and includes a vertical actuator leg 102, a horizontal spacer member 104 with a spring mounting projection 106, a vertical neck 108, and a switch actuating finger 110. Vertical neck 108 has a pair of mounting slits 112 which, in assembly, receive prongs 98 which are then bent upwardly to pivotally couple or link unbalanced lever 40 to lid lever 38. With reference again to FIG. 2, the linkage of lid lever 38 and unbalanced load lever 40 is then connected to switch holder 36 by inserting the fingers 74 of pivot portion 72 through slot 90, and then twisting or bending fingers 74 to secure assembly 32 together. Finally, spring 42 is connected between spring attaching hole 64 of switch holder 36 and spring mounting projection 106 of unbalanced load lever 40. With such arrangement, lid lever 38 is substantially horizontal and is pivotally mounted to switch holder 36. Unbalanced load lever 40 is substantially vertical and is pivotally mounted to lid lever 38 such that unbalanced load lever 40 moves up and down as lid lever 38 is pivoted about the hinge at pivot portion 72. In an unbiased or contracted state, spring 42 pulls unbalanced load lever 40 including switch actuating finger 110 upwardly such that plunger 78 of switch 34 is not depressed.

Figure 8:
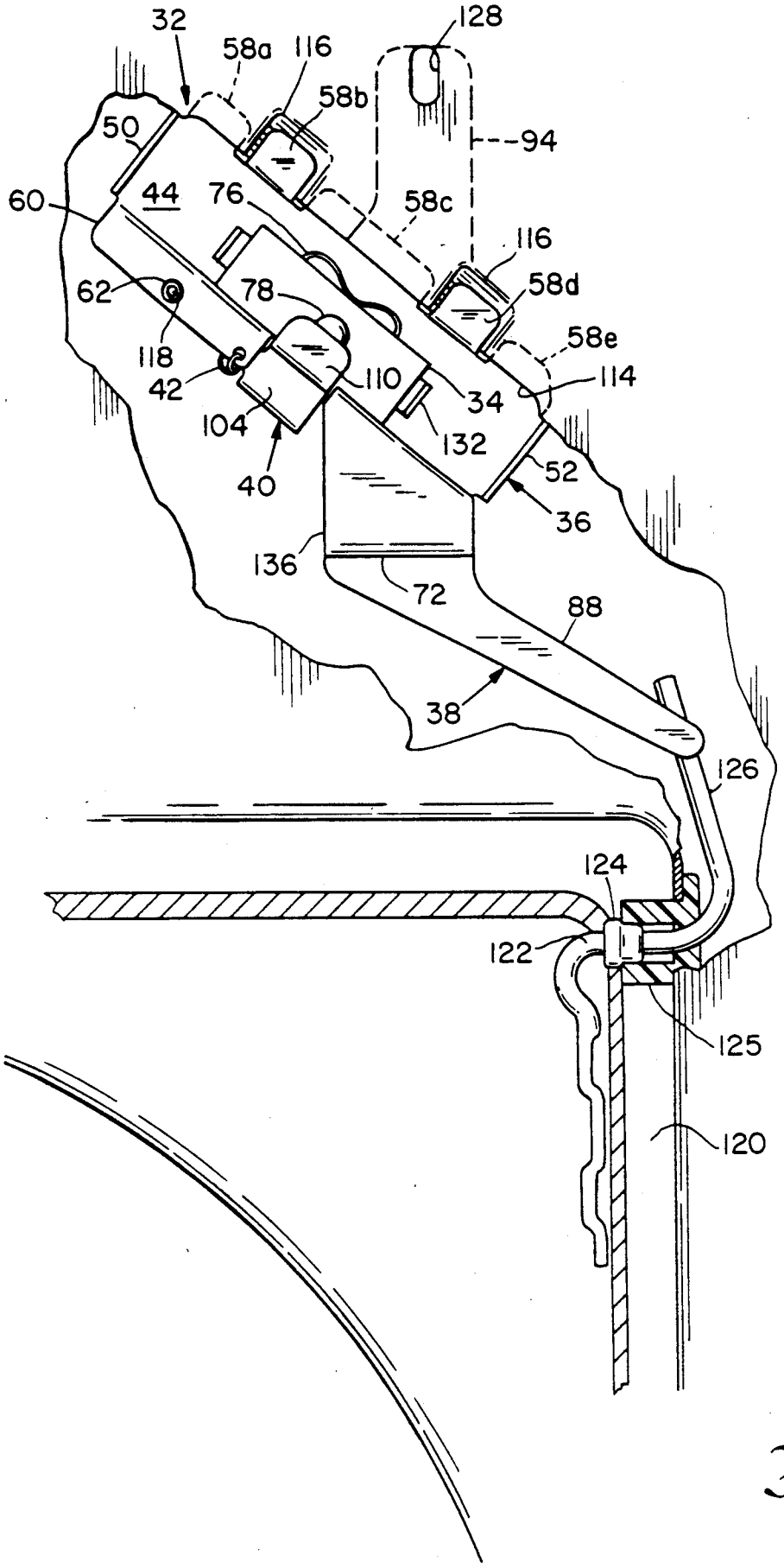
FIG. 8 is a partially broken away top view of the top panel of the washing machine with the combination switch assembly mounted thereto.

Referring to FIG. 8, switch assembly 32 is mounted to the underside of top panel 14. More specifically, top panel 14 has an aperture 114 substantially the shape of the entrance into switch holder 36 beneath console hood 26. Depressions 116 are formed in top panel 14 along the perimeter of aperture 114, and tabs **58*b* and 58*d* are inserted into respective depressions 116 while the other tabs 58*a*, 58*c*, and 58*e* are located below top panel 14. Then, a screw 118 is driven up through mounting hole 62 into a corresponding hole in top panel 14 to securely engage switch assembly 32 to the underside of top panel 14. It is advantageous that switch assembly 32 can readily and securely be mounted to top panel 14 using a single screw 118. As shown in FIG. 8, switch assembly 32 is oriented such that actuator arm 88 of lid lever 38 extends forwardly and laterally to a position adjacent lid recess 120 in top panel 14. Still referring to FIG. 8 and also to FIG. 9, lid 22 has wireform hinges 122 with hinge bearings 124 that seat in suitable bearing retainers 125, and the right wireform hinge 122 has an extension wire 126 that is hidden beneath top panel 114 and bends rearwardly to a position underneath actuator arm 88** as shown.

Figure 10:
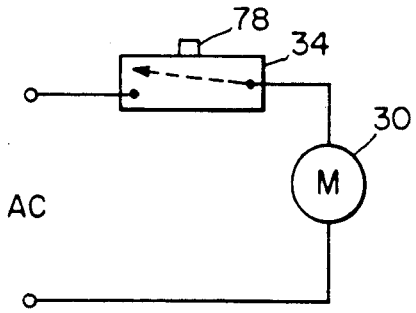
FIG. 10 is a schematic of the switch and motor.

In operation, switch assembly 32 is in its unbiased state when lid 22 is open, and thus plunger 78 of switch 34 is not depressed by switch actuating finger 110. Referring to FIG. 10, switch 34 is a normally open switch that is connected in series with motor 30 so that motor 30 cannot be energized unless plunger 78 is depressed. Accordingly, even though tub 28 may be filled with water when the lid 22 is open, washing machine 10 will not initiate an agitate or spin cycle with lid 22 open. When lid 22 is closed, extension wire 126 of right wireform hinge 122 rotates upwardly as shown best in FIG. 9, and applies an upward force on actuator arm 88. In response thereto, lid lever 38 pivots or hinges on pivot portion 72 thus pulling unbalanced load lever 40 downwardly against the bias of spring 42. As unbalanced load lever 40 moves downwardly, switch actuating finger 110 engages and depresses plunger 78 of switch 34. In such manner, motor 30 is enabled as shown in FIG. 10 so that it may be energized for agitation and spin operation.

Still referring to FIG. 8, extension 94 extends rearwardly and aligns with a top panel hole 128 which is behind the back panel 129 of console hood 26. When it is necessary for a service technician to override or defeat the safety interlock of lid switch 34 during maintenance, a screwdriver or other slim instrument can be pushed down through hole 128 so as to lower unbalanced load lever 40 and enable motor 30 notwithstanding lid 22 being opened. With the location of hole 128 behind console hood 26, the normal user will not be aware of the existence of the hole 128 and therefore will not be able to override the safety interlock feature of lid switch 34. Also, if the enamel of the top panel 14 is scratched or chipped by the screwdriver, the damage will not detract from the front appearance of washing machine 10.

Figure 11:
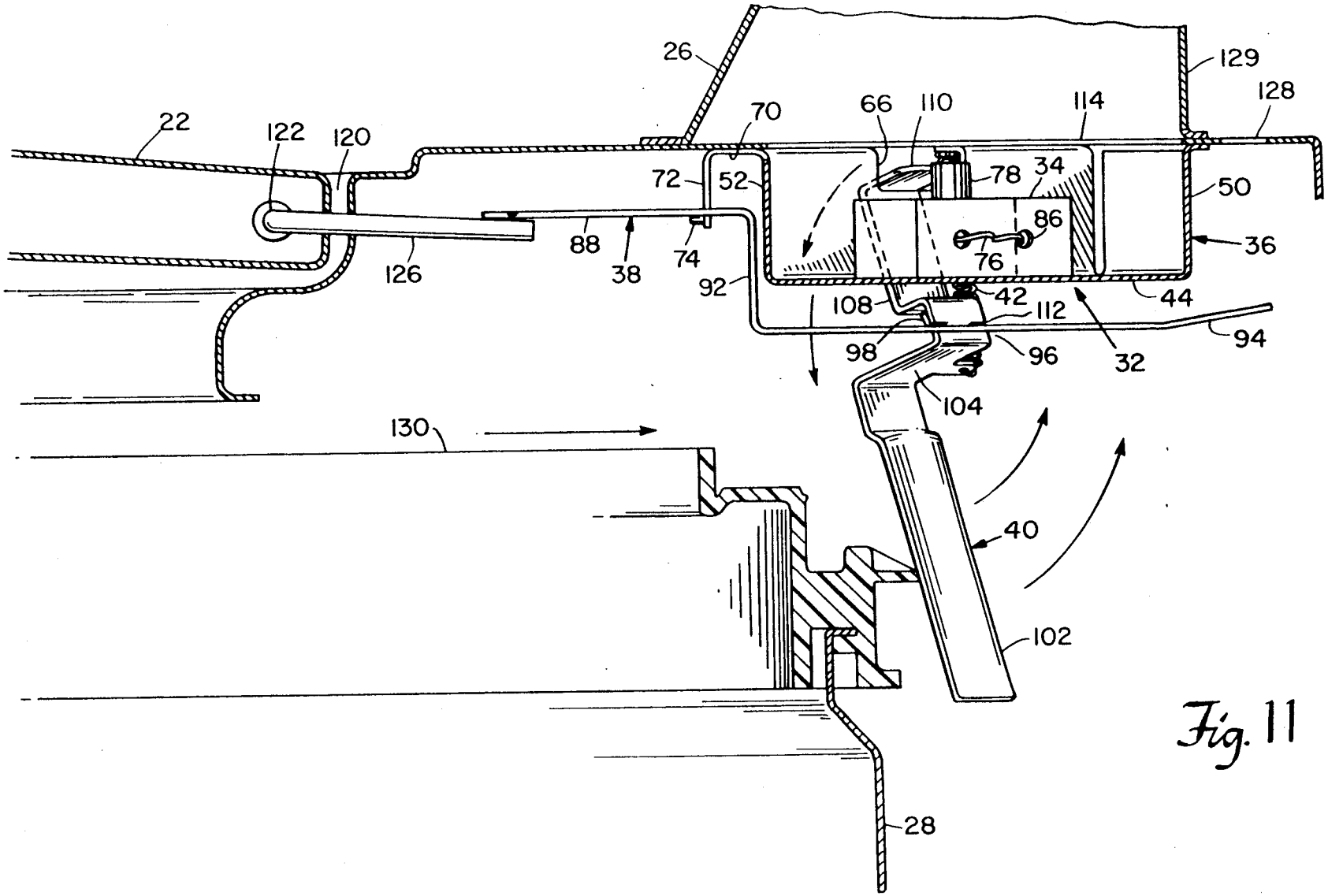
FIG. 11 is the same view as FIG. 9 with the unbalanced load lever being actuated by the outer tub.

Referring to FIG. 11, an unbalanced load condition during a spin cycle will cause the outer tub 28 to have a horizontal excursion from its normal position such that the tub cover 130 pushes against vertical actuator arm 102 or paddle of the unbalanced load lever 40. Such action causes unbalanced load lever 40 to pivot about its linkage or hinge to lid lever 38. More specifically, the linkage of prongs 98 into mounting slits 112 is loose enough such that unbalanced load lever 40 rotates or pivots from its normal substantially vertical orientation and, as a result, switch actuating finger 110 slides horizontally off of switch plunger 78. With such action, plunger 78 moves upwardly to its resting or unbiased height thus deactivating motor 30 as shown in FIG. 10. As the horizontal force from tub cover 130 is removed from actuator leg 102, spring 42 biases unbalanced load lever 40 back towards its normal substantially vertical orientation, but switch actuating finger 110 contacts the side of plunger 78 thereby preventing complete return. In order to reset the switch assembly 32 so that motor 30 can once again be reactivated, the lid 22 must first be opened which is a feature that reminds the operator to rearrange the clothes load. As lid 22 is raised, the force of extension wire 126 on actuator arm 88 is removed, and spring 42 is permitted to pull unbalanced load lever 40 upwardly so that the switch actuating finger 110 is above plunger 78 at its resting height. That is, switch actuating finger 110 slides up the side of plunger 78 and returns to its original position above plunger 78 as shown in FIG. 2. Then, as lid 22 is lowered, extension wire 126 once again activates switch assembly 32 so as to enable motor 30.

In summary, lid lever 38 pivots on pivot portion 72 of the switch holder 36 in response to lid 22 being closed, and thereby pulls unbalanced load lever 40 downwardly so that switch actuation finger 110 depresses plunger 78. While depressed, unbalanced load lever 40 may be pivoted at linkage 96 in response to tub cover 130 thereby rotating switch actuation finger 110 off of plunger 78 to disable motor 30. In other words, linkage 96 is a moving pivot wherein unbalanced load lever 40 pivots on the lid lever 38 which pivots on switch holder 36. Switch holder 36 also provides an box-like enclosure for shielding switch 34 and the terminals 132 to which interconnecting wires (not shown) are connected. Switch assembly 32 is coupled together by bending prongs 98, by twisting fingers 74, and by attaching spring 42. Accordingly, no screws or similar fasteners are required to assemble switch assembly 32, and only one screw 118 is required to connect switch assembly 32 to top panel 14. Accordingly, the labor to fabricate and install switch assembly 32 is simplified. Switch assembly 32 can be overridden by a service technician during diagnostic testing, but the actuation hole 128 is located behind console hood 26 where its existence is not easily discernible to the normal operator. In order to access switch assembly 32 for maintenance, console hood 36 is first removed. Another advantage of switch assembly 32 is that if the unbalanced load lever 40 is triggered in response to a force from tub cover 130, the lid 22 must be opened in order to reset switch assembly 32.

This concludes the description of the preferred embodiment. A reading of it by those skilled in the art will bring to mind many alterations and modifications which do not depart from the spirit and scope of the invention.

Accordingly, it is intended that the scope of the invention be limited only by the appended claims.

What is claimed is:

1. In a washing machine having a clothes basket positioned in a tub inside a cabinet having a lid wherein the washing machine further includes means for spinning said clothes basket during a spin cycle, a switch assembly for disabling said spinning means whenever said lid is open or whenever said clothes basket has an unbalanced load during one of said spin cycles, said switch assembly comprising:

a switch having a plunger;

a lid lever comprising a pivot and an actuator arm responsive to said lid being in a closed position for pivoting said lid lever;

an unbalanced load lever comprising a switch plunger actuating finger, said unbalanced load lever being pivotally linked to said lid lever wherein said unbalanced load lever is pulled by said lid lever such that said actuating finger depresses said switch plunger when said lid lever is pivoted by closing said lid; and said unbalanced load lever further comprising a downward extension responsive to lateral excursion of said tub during a spin cycle caused by an unbalanced load in said clothes basket for pivoting said unbalanced load lever with respect to said lid lever wherein said actuating finger slides off said switch plunger to disable said spinning means.

2. The washing machine recited in claim 1 wherein said spinning means comprises a motor and said switch is a normally open switch in series with said motor.

3. The washing machine recited in claim 1 further comprising means for biasing said unbalanced load lever to a position wherein said switch plunger is not depressed by said actuating finger when said lid lever is not pivoted by said lid being closed.

4. The washing machine recited in claim 3 wherein said biasing means comprises a spring connected to said unbalanced load lever.

5. The washing machine recited in claim 1 wherein said lid has a wire hinge with an angled extension that moves upwardly as said lid is being closed to apply a force to pivot said lid lever.

6. The washing machine recited in claim 1 wherein said lid lever has an extension aligned with a hole in said top panel wherein an implement can be pushed down through said hole to pivot said lid lever when said lid is open.

7. The washing machine recited in claim 6 further comprising a control console, said hole in said top panel being positioned behind said control console.

8. A washing machine comprising:

a cabinet comprising a top panel with a lid having a hinge with an extension that moves upwardly while said lid is closing;

a tub positioned in said cabinet;

a clothes basket positioned in said tub;

means for spinning said clothes basket during a spin cycle; and a combination switch assembly for disabling said spinning means in response to said lid being open or said clothes basket having an unbalanced load during one of said spin cycles, said switch assembly comprising:

(a) a switch having a plunger;

(b) a housing for holding said switch, said housing having a projection with a pivot portion;

(c) a lid lever pivotally coupled to said pivot portion of said housing, said lid lever having an actuation arm responsive to said lid hinge closing for pivoting said lid lever;

(d) an unbalanced load lever comprising a switch plunger actuating finger, said unbalanced load lever being pivotally linked to said lid lever wherein said unbalanced load lever is pulled downwardly by said lid lever such that said actuation finger depresses said switch plunger when said lid lever is pivoted by said lid hinge moving to a closed position; and (e) said unbalanced load lever further comprising a downward extension responsive to a lateral excursion of said tub during a spin cycle caused by an unbalanced load in said clothes basket for pivoting said unbalanced load lever with respect to said lid lever wherein said actuating finger slides off said switch plunger to disable said spinning means.

9. The washing machine recited in claim 8 wherein said lid lever is substantially horizontal and said unbalanced load lever is substantially vertical.

10. The washing machine recited in claim 8 wherein said combination switch assembly further comprises a spring for biasing said unbalanced load lever upwardly when said load lever is unpivoted by said extension of said lid hinge.

11. The washing machine recited in claim 8 further comprising an agitator in said clothes basket and wherein said spinning means further comprises means for agitating said agitator.

12. The washing machine recited in claim 8 further comprising a control console mounted to said top panel and a hole in said top panel behind said console, said lid lever comprising an extension aligned with said hole wherein an implement can be inserted through said hole to pivot said lid lever to pull said unbalanced load lever downwardly to depress said switch plunger while said lid is open.

13. The washing machine recited in claim 8 wherein said switch housing has a side wall with a pair of slots and said switch is mounted to said side wall by a spring clip having a pair of legs extended through corresponding lateral holes in said switch, said legs having hook ends inserted through said respective slots in said side wall.

14. A washing machine comprising:

a cabinet comprising a top panel with a lid having a hinge with an extension that moves upwardly while said lid is closing;

a tub positioned in said cabinet;

a clothes basket positioned in said tub;

an agitator positioned in said clothes basket;

means for agitating said agitator and for spinning said clothes basket during a spin cycle; and a combination switch assembly for disabling said agitating and spinning means in response to said lid being open or said clothes basket having an unbalanced load during one of said spin cycles, said switch assembly comprising:

(a) a switch having a pair of through holes and a plunger;

(b) a box-like housing holding said switch, said housing having a side wall with a pair of slots and a flange with a hole and a horizontal projection with a downwardly extending pivot portion having a plurality of fingers;

(c) a spring clip having a pair of legs inserted through said holes of said switch, said legs having hook ends inserted through and engaging said slots in said side wall of said housing securing said switch to said side wall;

(d) a lid lever having a slot, said fingers of said pivot portion being inserted through said slot of said lid lever and being twisted to pivotally engaged said lid lever to said pivot portion of said housing, said lid lever having a first portion to one side of said lid lever slot adapted for engagement with said extension of said hinge wherein said lid lever is pivoted at said pivot portion in response to said lid being closed, said lid lever further having a second portion to the opposite side of said lid lever slot;

(e) an unbalanced load lever pivotally connected to said second portion of said lid lever wherein, when said second portion is pivoted downwardly, said unbalanced load lever is pulled downwardly, said unbalanced load lever having an actuating finger for depressing said plunger of said switch when said unbalanced load lever is pulled downwardly;

(f) a spring connected between said flange of said housing and said unbalanced load lever for applying an upward force on said unbalanced load lever so that said actuating finger only depresses said switch plunger when said lid is closed; and (g) said unbalanced load lever further comprising a downward extension responsive to a lateral excursion of said tub during a spin cycle caused by an unbalanced load in said clothes basket for pivoting said unbalanced load lever with respect to said lid lever wherein said actuating finger slides off said switch plunger to disable said spinning means.

* * * * *